United States Patent [19]

Horng

[11] Patent Number: 4,671,213

[45] Date of Patent: Jun. 9, 1987

[54] STRUCTURAL IMPROVEMENT IN THE BURNING CHAMBER OF A HORIZONTAL BOILER

[76] Inventor: Horng-Her Horng, 72, Chung Cheng Road, Mei Shan Hsiang, Chiayi Hsien, Taiwan

[21] Appl. No.: 842,178

[22] Filed: Mar. 21, 1986

[51] Int. Cl.[4] ..... F22B 7/00; F22B 31/02

[52] U.S. Cl. ..... 122/136 R; 122/149; 122/159

[58] Field of Search ..... 122/136 R, 136 C, 149, 122/159, 161, 165, 140 R

[56] References Cited

U.S. PATENT DOCUMENTS

| | | | |
|---|---|---|---|
| 3,389,692 | 6/1968 | Johnson et al. | 122/136 R |
| 4,291,649 | 4/1981 | Boder | 122/136 R |
| 4,465,025 | 8/1984 | Schroder | 122/161 X |
| 4,488,514 | 12/1984 | de Poray et al. | 122/149 |

*Primary Examiner*—Edward G. Favors

*Attorney, Agent, or Firm*—Cushman, Darby & Cushman

[57] ABSTRACT

The present disclosure is related to a structural improvement in the burning chamber of a horizontal boiler, adopting a hollow flame-conducting element therein, which is attached with a pair of parallelly spirally fixed heat-convecting fins for either increasing the heat-absorbing area subjected to the emitted flame from the flame-generating device or creating a whirlpool effect for the propagating flame so that the flame can come into contact with the wall of the burning chamber in a more ideal way and change its propagating direction more smoothly at the corner, resulting in an increase in the thermal efficiency of the boiler, in such a manner that energy consumption as well as a pollution problem can be alleviated greatly.

1 Claim, 3 Drawing Figures

STRUCTURAL IMPROVEMENT IN THE BURNING CHAMBER OF A HORIZONTAL BOILER

BACKGROUND OF THE INVENTION

1. Field of the Invention

The present disclosure relates to an improvement in an inefficient burning chamber arrangement of a conventional horizontal boiler, and more particularly to a hollow tube-like flame-conducting element having projected fins fixed parallelly and spirally along the outer surface thereof, for both increasing the heat-absorbing area of the burning chamber and making the propagating flame move forward in a whirlpool manner so as to improve the thermal efficiency of the horizontal boiler, resulting in less energy consumption and reduction in the time requirement to transform a unit volume of water to steam.

2. Description of the Related Art

In a conventional horizontal boiler, the burning chamber is arranged in a straight-line manner, i.e., the propagating flame progresses to the end of the 1st burning chamber and then is bounced into the 2nd burning chamber in a turbulent manner against the wall of the boiler and moves into an attached chimney. Also (as shown in FIG. 1), the 1st and 2nd burning chambers of the boiler are surrounded by a water jacket including a plurality of communicable pipes through which cold water to be heated in the process by the flame is made to flow from the water inlet 23 therealong, while the flame is propagating between said pipes for achieving its heating purpose. The deficiency with the conventional horizontal boiler lies in the propagation of the flame which starts from the injection and propagates into a burning tank 25 where the flame is in a turbulent state and changes its propagation direction inversely into the 2nd burning chamber. In the 2nd burning tank the flame is conducted into the final duct and released into the atmosphere via a chimney. The manner in which the flame is conducted in the conventional horizontal boiler makes it difficult to transmit its thermal energy effectively to the pipes therein and also produces a tremendous resistance against the flame propagation in said burning tanks 25, 26. Therefore, a lot of thermal energy is wasted, which is then released into the atmosphere via the chimney, causing air pollution.

The inventor, viewing the deficiency as well as the disadvantages with the conventional horizontal boiler, has devoted his experience in fabricating boilers to providing an improved boiler in which the flame can propagate in a more steady manner with minimum resistance and thermal energy can be better transmitted so that the thermal efficiency of the boiler can be increased satisfactorily. The effort comes to fruition only after a series of experiments and improvements on the models the inventor has built.

SUMMARY OF THE INVENTION

The primary object of the present invention is to provide an improvement in the burning chamber arrangement of the conventional horizontal boiler which is characterized in the adoption of a flame-conductive element which is disposed in the 1st burning chamber oppositely to the flame-generating device from which the flame is initiated, making the flame-conducting element subjected to the propagating flame totally for a better energy-transmitting purpose, so that the heated water can be steamed more quickly than a boiler without the flame-conducting element.

The further object of the present invention is to provide a flame-conducting element in a conventional horizontal boiler, which is hollow in structure and has a pair of parallelly and spirally fixed heat-convecting fins along the outer surface thereof for either increasing the heat-absorbing area or making the propagating flame move in a whirlpool manner so that the flame can come into contact with the wall of the burning chamber in a more ideal way and can move into the 2nd burning chamber more smoothly with minimum turbulence than the flame in a conventional boiler, resulting in a better heat convecting effect.

The characteristics of the improved structure of the present disclosure becomes apparent when the description is read with the accompanying drawings.

DETAILED DESCRIPTION OF THE PREFERRED EMBODIMENT

Figure 1:
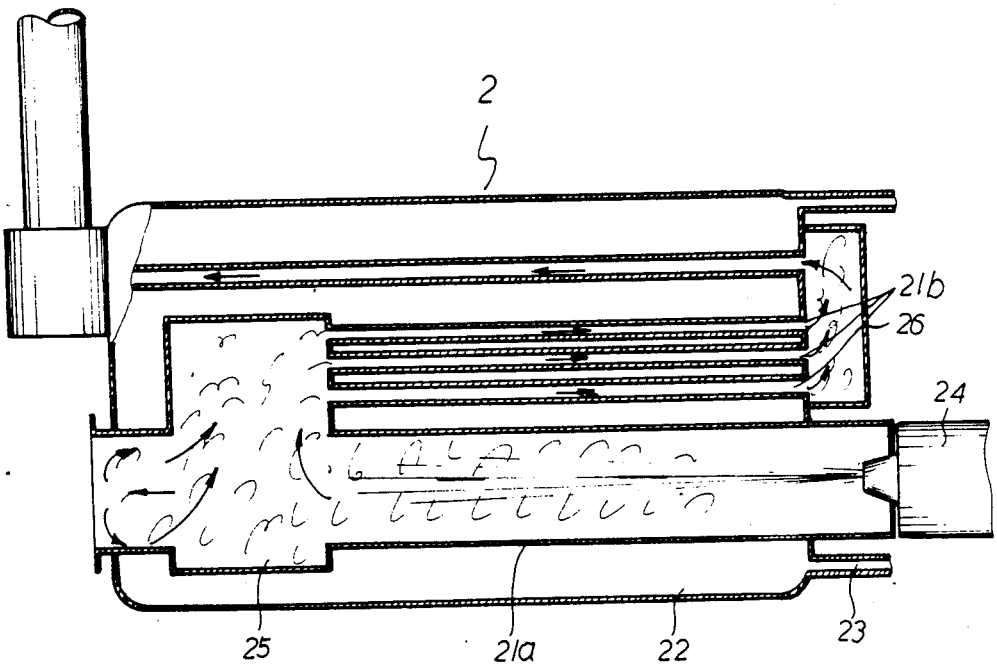
FIG. 1 is a sectional view of a conventional horizontal boiler.
Figure 2:
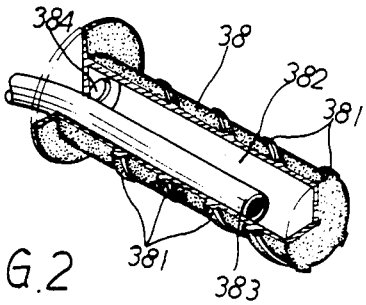
FIG. 2 is a perspective view of the flame-conducting element of the present invention.
Figure 3:
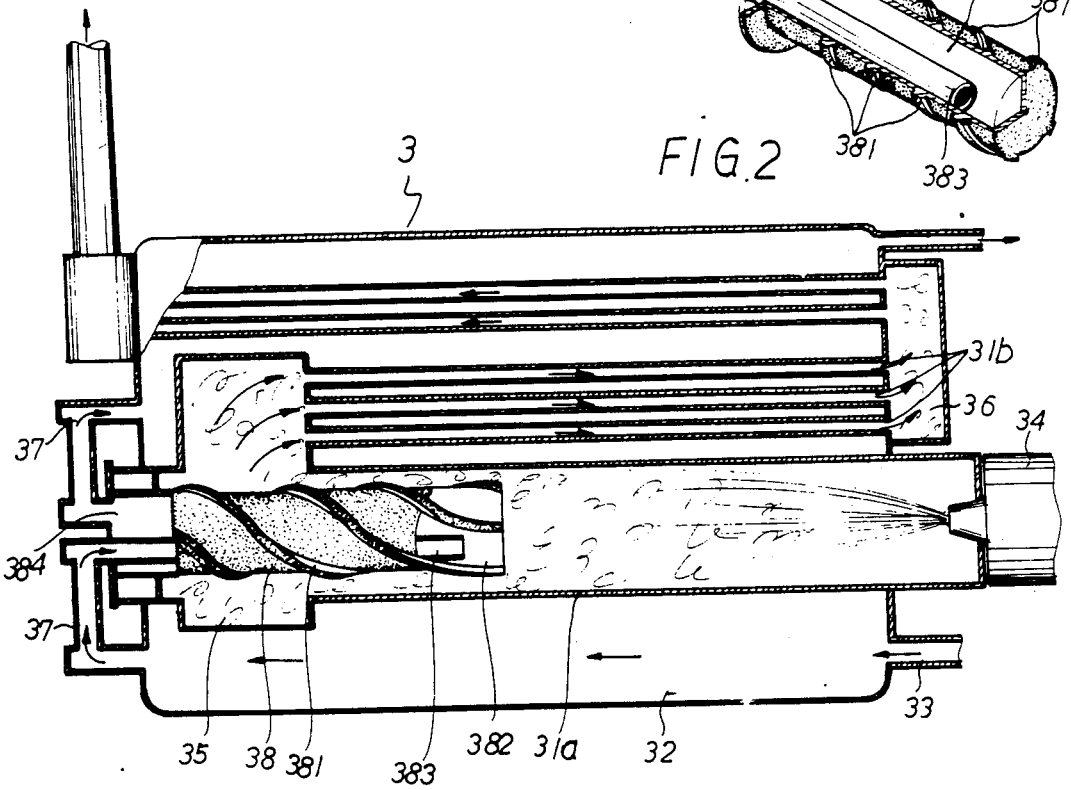
FIG. 3 is a sectional view of the present invention.

Referring to FIG. 2 and FIG. 3, the present invention is an improved arrangement in the embodiment of a horizontal boiler having the horizontally-disposed cylindrical 1st and 2nd burning chambers 31*a*, 31*b* surrounded by the water jacket 32 into which cold water is supplied from a water inlet 33. At one end of said 1st burning chamber 31*a*, there is disposed a flame-generating device 34 which gives off flame into the chamber 31*a*. At the other end thereof, there is placed a first burning tank 35 which extends into the 2nd burning chamber 31*b* to another second burning tank 36, located on the same side of said flame-generating device 34 and further connected to a chimney. A plurality of tubes are parallely disposed between said burning tanks 35, 36 (as in a conventional horizontal boiler). A flame-conducting element 38, having a pair of parallely and spirally disposed heat-convecting fins welded to the outer surface thereof, a hollow tube having one end closed and also having an inner cabin 382 which contains a water duct 383 connected to said water jacket 32 via a water duct 37, into which water is fed and preheated. The water then flows into the water jacket 32 around the 2nd burning chamber 31*b* via a round opening 384 (as shown in FIG. 2).

The present invention is characterized in the adoption and the arrangement of the flame-conducting element 38 in the 1st burning chamber 31*a*, oppositely disposed to the flame-generating device 34.

The installation of said flame-conducting element 38 and the arrangement of heat-convecting fins 381 therearound make the injected flame from the flame-generating device 34 come into contact with said element 38 in a better energy-transmitting manner so as to heat up the water flowing through the inner tubes in the improved horizontal boiler more quickly than a conventional boiler. The water flowing from the water inlet 33 into the water jacket 32 is preheated in the process and guided further into the inner cabin 382 of the flame-conducting element 38 via a duct 383, being heated continuously in the journey, so that the time required to transform water into steam is shortened and the energy consumption is lowered because of the advancement of the thermal efficiency of the improved horizontal boiler.

Moreover, the adoption of the projected and spirally-disposed heat-convecting fins 381 of the flame-conducting element 38, disposed oppositely to the flame-generating device 34, creates a whirlpool effect for the propagating flame so that the flame can be propagated more smoothly into the 2nd burning chamber 31*b* and all the way without causing too much turbulence in the first burning tank 35, which is often encountered in the conventional horizontal boiler and has a bad effect on the burning efficiency of the flame. In such a manner, the efficiency of the horizontal boiler is accordingly improved, and the air pollution problem is also alleviated with the improved burning condition.

What is claimed is:

1. A horizontal boiler comprising:

a burning chamber having a first end and a second end;

a water jacket means for surrounding the burning chamber;

a flame-generating device arranged at the first end of the burning chamber;

a flame-conducting element arranged at the second end of the burning chamber and disposed oppositely to the flame-generating device, said flame-conducting element being a tube with one end facing the flame-generating device being closed and with an opposite end arranged away from the flame-generating device, said opposite end having an opening therein, said flame-conducting element also having an outer surface;

heat-convecting fins parallely and spirally fixed along and projecting from the outer surface of the flame-conducting element;

inlet duct means for transferring water from the jacket means to the flame-conducting element;

outlet duct means for transferring water from the flame-conducting element back to the jacket means; and cabin means, arranged inside the flame-conducting element, for receiving water from the jacket means via the inlet duct means and for redirecting the water through the opening in the opposite end of the flame-conducting element into the outlet duct means;

whereby a whirlpool effect is created for the generated flame to improve conditions inside the burning chamber.

* * * * *